United States Patent [19]

Yukimoto et al.

[11] Patent Number: 4,695,036

[45] Date of Patent: Sep. 22, 1987

[54] SCREW BAR FOR A PANTOGRAPH-TYPE JACK

[75] Inventors: Kazuyoshi Yukimoto, Kariya; Kenichi Fukura; Nobuhiro Yamauchi, both of Toyota, all of Japan

[73] Assignee: Aisin Seiki Kabushiki Kaisha, Japan

[21] Appl. No.: 813,975

[22] Filed: Dec. 27, 1985

[30] Foreign Application Priority Data

Dec. 27, 1984 [JP] Japan ..... 59-279054

[51] Int. Cl.[4] ..... B66F 3/22

[52] U.S. Cl. ..... 254/126

[58] Field of Search ..... 254/122, 126, 98, 7 R, 254/7 B, 7 C

[56] References Cited

U.S. PATENT DOCUMENTS

| | | | |
|---|---|---|---|
| 1,576,721 | 3/1926 | Conrad | 254/122 |
| 2,467,657 | 4/1949 | Brown | 254/126 |
| 3,906,777 | 9/1975 | Dickens | 254/126 |
| 4,549,721 | 10/1985 | Stone | 254/126 |

FOREIGN PATENT DOCUMENTS

| | | | |
|---|---|---|---|
| 744762 | 1/1933 | France | 254/126 |
| 57-15911 | 2/1982 | Japan . | |
| 1666 | of 1910 | United Kingdom | 254/126 |
| 275244 | 1/1928 | United Kingdom | 254/126 |

*Primary Examiner*—Robert C. Watson

*Attorney, Agent, or Firm*—Finnegan, Henderson, Farabow, Garrett & Dunner

[57] ABSTRACT

A screw bar for connecting a nut member and a bearing member of a pantograph-type jack includes a cylindrical-shaped bar member having a joint portion formed integrally with the bar member at one end and a threaded portion formed integrally on the bar member at the other end. The nut member of the jack is threadably engageable with the threaded portion of the screw bar, and the bearing member of the jack is pivotally mountable on the bearing support portion of the screw bar. The maximum outer diameter of the threaded portion is less than or equal to the desired diameter of the bearing support portion so that the bearing member can be mounted on the screw bar from the threaded-portion end. Preferably, the joint portion includes a flange portion having an outer diameter greater then the desired diameter and the bearing support portion is provided with a lug portion. The lug portion and the joint portion are positioned on opposite sides of the bearing member mounted on the bearing support portion to prevent axial movement of the bearing member. A method for forming the screw bar also is disclosed.

3 Claims, 11 Drawing Figures

SCREW BAR FOR A PANTOGRAPH-TYPE JACK

BACKGROUND OF THE INVENTION

1. Field of the Invention

The present invention relates to a pantograph-type jack and, more particularly, to a screw bar for a pantograph-type jack.

2. Description of the Prior Art

A conventional pantograph-type jack such as that shown in Japanese Utility Model Publication No. 57-15911 is known. A conventional pantograph-type jack, such as that shown in FIGS. 1A and 1B, includes a pair of lower arms 2, a pair of upper arms 3, a load-receiving plate 4 pivotally connecting the upper arms, and a base plate 5 pivotally connecting the lower arms and supporting the jack. The left-side upper and lower arms are pivotally connected to a nut member 6, and the right-side arms are pivotally connected to a bearing member 7. A screw bar 10 pivotally supported by the bearing member is threadably engaged with the nut member, and the load-receiving plate is raised and lowered by the rotation of the screw bar 10, in a manner well known in the art.

A joint portion 11 is fixed to one end of the screw bar 10, and a crank handle (not shown) or the like is engaged with the joint section 11. Accordingly, the screw bar 10 is rotated by the operation of the crank handle.

In the conventional jack shown in FIGS. 1A and 1B, the joint portion 11 is fixed to the screw bar 10 by a connection screw 12, which is shown in FIG. 1B, that necessarily has a smaller diameter than the screw bar 10. The joint portion 11 is fixed to the screw bar 10 with the connection screw 12 through a washer 13. The washer 13 is interposed between the screw bar 10 and the joint portion 11 to provide a bearing surface contacting bearing 7 and to prevent the joint portion 11 from loosening.

Construction of the conventional pantograph-type jack thus requires a specially formed joint portion 11 in addition to the screw bar 10, and the number of parts is increased. Furthermore, dimensional accuracy must be increased to prevent looseness at the connection between the connection screw 12, the screw bar 10, and the joint portion 11. Moreover, the connection screw 12 must have a small diameter, in comparison with the other portion of the screw bar 10, so that the mechanical strength of the connection of the joint portion 11 to the screw bar 10 is decreased.

An object of the present invention is to provide an improved screw bar for a pantograph-type jack that obviates the aforementioned disadvantages of the illustrated conventional screw bar.

A further object of the present invention is to provide an improved screw bar having high reliability.

A still further object of the present invention is to provide an improved screw bar that includes a minimum number of parts.

Additional objects and advantages of the present invention will be set forth in part in the description that follows and in part will be obvious from that description or can be learned from practice of the invention. The advantages of the invention can be realized and obtained by the apparatus particularly pointed out in the appended claims.

SUMMARY OF THE INVENTION

The present invention overcomes the problems of the prior art screw bars used with pantograph-type jacks by providing a screw bar having a joint portion integrally formed on one end of the screw bar.

To overcome the problems of the prior art and in accordance with the purpose of the invention, as embodied and broadly described herein, the screw bar of the present invention for connecting a nut member and a bearing member of a pantograph-type jack comprises a cylindrical-shaped bar member having a first end and a second end; a joint portion integral with the bar member at the first end; and a threaded portion formed on the bar member at the second end, the nut member being threadably engageable with the threaded portion.

Preferably, the screw bar of the present invention further comprises a bearing support portion adjacent the joint portion and having a desired diameter. The bearing member of the pantograph-type jack is pivotally mountable on the bearing support portion. A lug portion preferably is mounted on the bearing support portion, the lug portion and the joint portion being positioned on opposite sides of the bearing member and preventing movement of the bearing member in the direction of the axis of the screw bar. Preferably, the screw bar also comprises a thrust washer pivotally mounted on the bearing support portion and interposed between the joint portion and the bearing member when the bearing member is mounted on the bearing support portion. The maximum outside diameter of the threaded portion preferably is less than the desired diameter of the bearing support portion, and the joint portion preferably includes a flange portion having an outer diameter greater than the desired diameter of the bearing support portion.

Broadly, the present invention also includes a method for manufacturing a screw bar for a pantograph-type jack that comprises the steps of preparing a length of bar material having a desired diameter; forming a two-stepped flange member at one end of the bar material, the flange member including a first portion having a maximum outer diameter larger than the desired diameter of the bar material and a second portion adjacent the first portion; forming the second portion of the flange member into a flat shape; providing an engaging hole in the flat-shaped second portion of the flange member to form a joint portion; stretching the bar material in the axial direction away from the joint portion to form a thread-rolling portion while leaving a portion of a certain length adjacent the joint portion unstretched, the thread-rolling portion having a diameter smaller than the desired diameter, and the diameter of the unstretched portion being maintained at the desired diameter; and forming a threaded portion on the thread-rolling portion, the threaded portion having a maximum outer diameter less than or equal to the desired diameter.

The accompanying drawings, which are incorporated in and which constitute a part of this specification, illustrate one embodiment of the invention and, together with the description, explain the principles of the invention.

DETAILED DESCRIPTION OF THE PREFERRED EMBODIMENT

Reference now will be made in detail to a presently preferred embodiment of the invention, an example of which is illustrated in the accompanying drawings.

Figure 3:
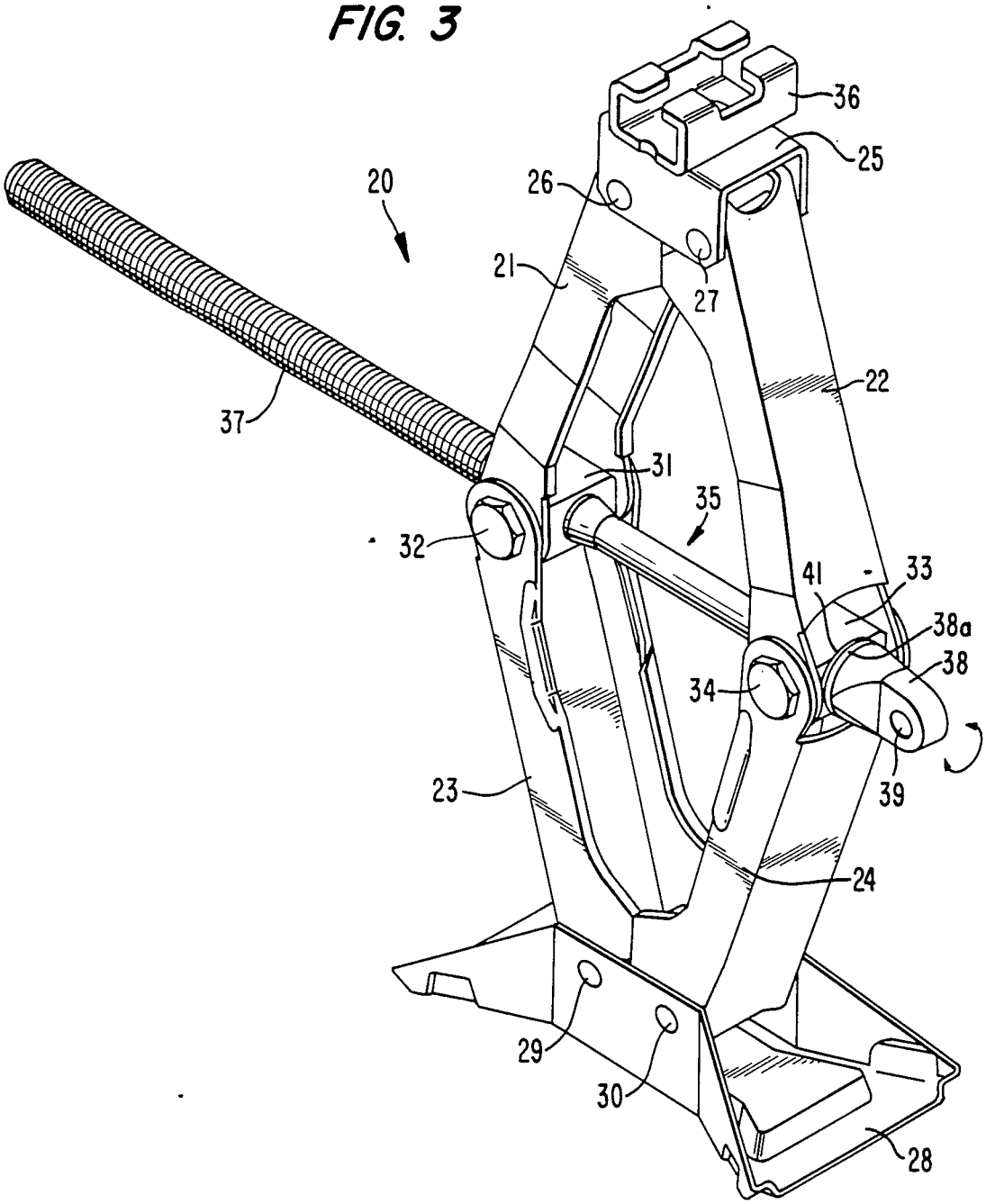
FIG. 3 is a perspective view showing a pantograph-type jack provided with the screw bar of FIG. 2.

Referring now to FIG. 3, reference numeral 20 denotes a pantograph-type jack that has two pairs of arms, a pair of upper arms 21, 22 and a pair of lower arms 23, 24. The upper arms 21, 22 are pivotally connected to a load-receiving plate 25 by pins 26, 27, and the lower arms 23, 24 are pivotally connected to a base plate 28 by pins 29, 30. Further, the left-side upper arm 21 and left-side lower arm 23 are pivotally connected to a nut member 31 by screws 32, and the right-side upper arm 22 and right-side lower arm 24 are pivotally connected to a bearing member 33 by screws 34. (In FIG. 3, one each of screws 32, 34 is shown.) A screw bar 35 is pivotally supported within a hole portion of the bearing member 33 and is threadably engaged with the nut member 31 so that arms 21, 22, 23, 24 are opened and closed by the rotation of the screw bar 35. Consequently, the load-receiving plate 25 and a vehicle-engaging portion 36 pivotally supported on the plate 25 are upwardly and downwardly moved by rotation of the screw bar 35.

Figure 2:
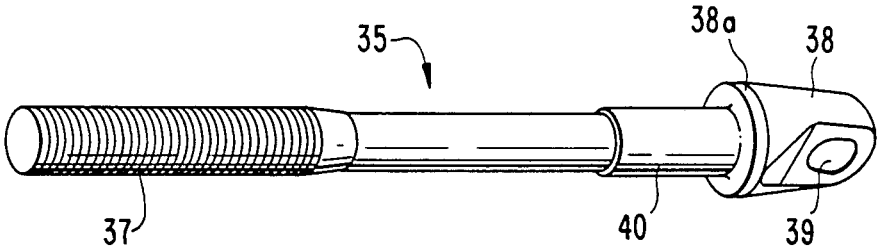
FIG. 2 is a perspective view showing an embodiment of the screw bar according to the present invention.

As viewed in FIGS. 2 and 3, the screw bar 35 includes an integrally formed threaded portion 37 on the left end and an integrally formed joint portion 38 on the right end. The threaded portion 37 of the screw bar 35 is threadably engaged with the nut member 31, and the joint portion 38 is provided with an engaging hole 39 for connecting joint portion 38 to a crank handle (not shown). Preferably, the end of the joint portion 38 opposite the hole 39 includes a flange portion **38*a* that is larger in diameter than the hole portion of bearing member 33**.

Figure 4:
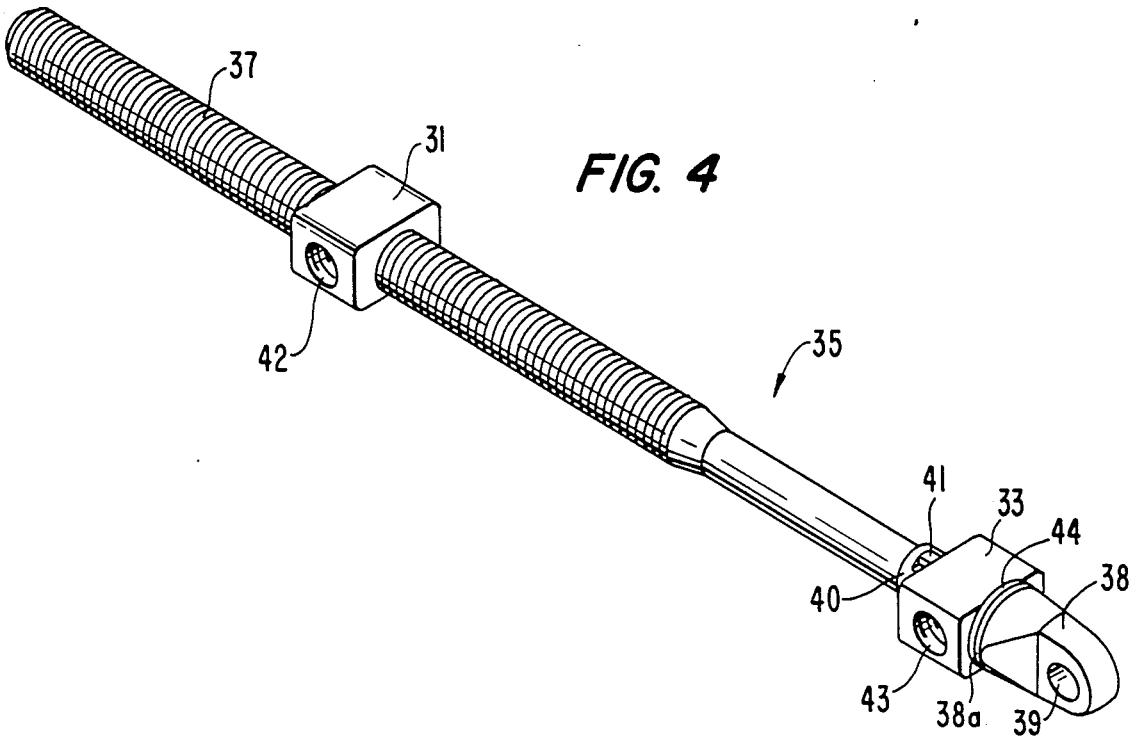
FIG. 4 is a perspective view similar to FIG. 2, showing the assembled state of a nut member and a bearing member with the screw bar of the present invention.

With reference to FIG. 2, the screw bar 35 includes a bearing support portion 40 adjacent the joint portion 38. As seen in FIG. 4, the bearing member 33 is pivotally supported on the bearing support portion 40. A lug portion 41 is provided on the bearing support portion 40 after portion 40 is inserted through the bearing member 33 to sandwich the bearing member 33 between the lug portion 41 and flange portion **38*a* of the joint portion 38. Therefore, the bearing member 33 is pivotally supported on the bearing support portion 40 but is prevented from moving in the axial direction of the screw bar 35. Screw holes 42, 43 for threadably engaging the screws 32, 34 are formed on both sides of the nut member 31 and the bearing member 33, respectively. A thrust washer 44 is interposed between the bearing member 33 and the flange portion 38*a* of the joint portion 38 to permit smooth rotation of the screw bar 35**.

The operation of the screw bar according to the present invention in conjunction with the pantograph-type jack shown in FIG. 3 now will be described.

The crank handle, not shown, is engaged with the engaging hole 39 of the joint portion 38 of the screw bar 35. The screw bar 35 is rotated by the operation of the crank handle. As a result, the threaded portion of the nut member 31 is displaced along the threaded portion 37 in the longitudinal direction of the screw bar 35 toward or away from the bearing member 33, which is pivotally mounted on the bearing support portion 40 and prevented from moving axially by lug portion 41 and joint portion 38. Consequently, the arms 21, 22, 23, 24 are opened or closed, and the load-receiving plate 25 is upwardly or downwardly moved.

The method for forming the screw bar 35 now will be described with reference to FIGS. 5A through 5F.

Figure 5A:
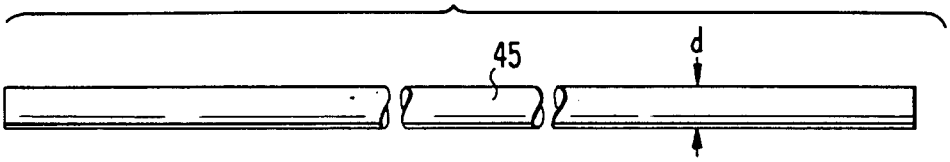
FIGS. 5A through 5F are front views showing a forming process for the screw bar of the present invention.
Figure 5B:
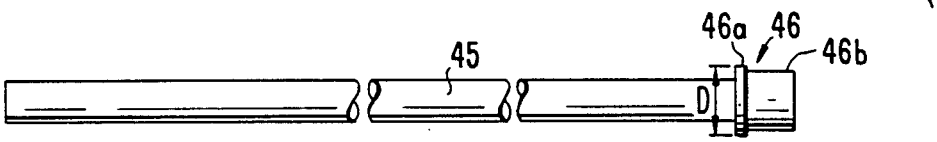
Figure 5C:
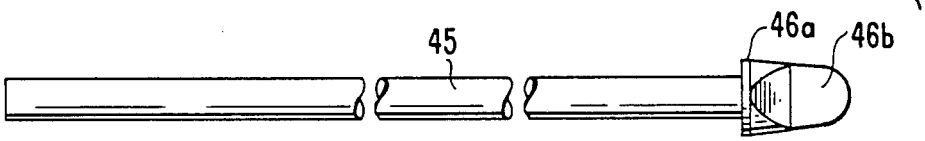
Figure 5D:
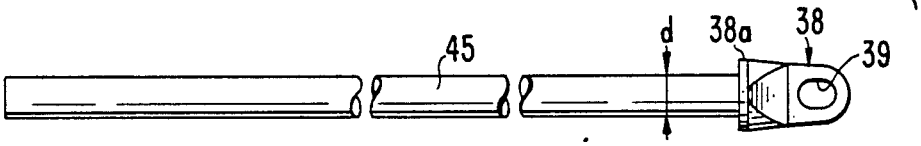

As viewed in FIG. 5A, a certain length of bar material 45 is fabricated to have a constant diameter d, which is substantially equal to the desired diameter of the bearing support portion 40 after manufacture. Next, a two-stepped flange member 46 including a first portion **46*a* having a maximum outer diameter D (D d) and a second portion 46*b* having a diameter smaller than D is formed by, for example, a cold forging process at the right end of the bar material 45 (FIG. 5B). The smaller second portion 46*b* of the flange member 46 then is formed into a flat shape by compressing the same from both sides (FIG. 5C). The engaging hole 39 is provided in the flat-shaped portion 46*b*, and the first portion 46*a* of flange member 46 remains as the flange portion 38*a* of the joint portion 38 (FIG. 5D). Thus, the joint portion 38** is formed.

Figure 5E:
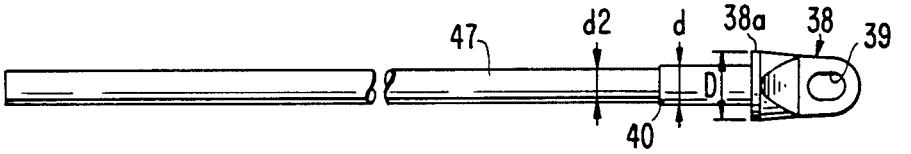
Figure 5F:
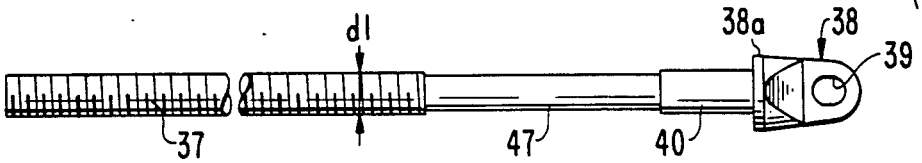

The portion of the bar material 45 to the left of the desired location of bearing support portion 40 then is stretched in the leftward axial direction to provide a thread-rolling portion 47 of diameter d2 ($d2<d$). The bearing support portion 40 of a certain length and diameter d remains adjacent the joint portion 38 (FIG. 5E). Thereafter, the threaded portion 37 is formed on the left-side portion of the thread-rolling portion 47 (FIG. 5F). The maximum outer diameter d1 ($d1>d2$) of the threaded portion 37 is less than or equal to the diameter d of the bar material 45 and bearing support portion 40. Thus, the screw bar 35 is processed.

Because the maximum outer diameter d1 of the threaded portion 37 of the screw bar 35 is less than or equal to the diameter d of the bar material 45 and the bearing support portion 40 and because the diameter d2 of the thread-rolling portion 47 is less than d, the bearing member 33 can be slipped onto the screw bar 35 from the side of the threaded portion 37 onto the bearing support portion 40, even if the joint portion 38 is integrally formed with the screw bar 35. Accordingly, there is no difficulty in assembling a pantograph-type jack using the screw bar of this invention.

The bearing support portion 40 of the screw bar 35 has substantially the same diameter as the bar material 45 for the screw bar 35. The screw bar of the present invention is formed by making the diameter of one portion of the bar material 45 a little larger for the formation of the the joint portion 38 and by making a second portion a little smaller for the formation of the thread-rolling portion 47 and threaded portion 37. Therefore, no special manufacturing is required, and the joint portion 38, the threaded portion 37, and the thread-rolling portion 47 have sufficient mechanical strength.

Figure 1A:
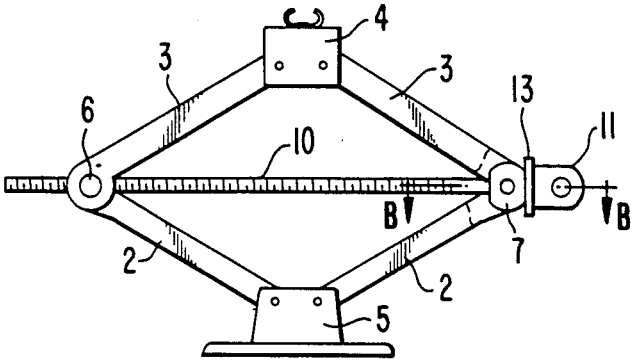
FIG. 1A PRIOR ART
FIG. 1A is an elevational view of a pantograph-type jack including a conventional screw bar.
Figure 1B:
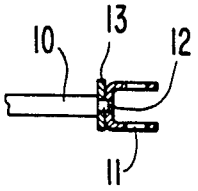
FIG. 1B PRIOR ART
FIG. 1B is a cross-sectional view of a part of the conventional screw bar shown in FIG. 1A, taken along line B—B.

Because the diameter d of the bearing support portion 40 of the screw bar 35 is large, relative to the connection screw 12 of FIG. 1B, for example, the stress on the bearing support portion 40 due to the load applied by bearing member 33 becomes small. As a result, the durability of the bearing support portion 40 is improved.

According to the present invention, the joint portion 38 is integrally formed with the screw bar 35, so that the screw bar 35 is formed by one piece of the bar material 45. Consequently, the construction will be simple and the mechanical strength is improved. To provide equal mechanical strength with the conventional screw bar of FIGS. 1A and 1B, the connection screw 12 of the conventional screw bar 10 would have to have a diameter substantially equal to the diameter d of the bearing portion 40 of the present invention. The conventional screw bar thus would have a diameter greater than d. As a result, the outer diameter of the screw bar 35 of the present invention can be reduced, so the weight of the jack can be minimized.

It will be apparent to those skilled in the art that modifications and variations can be made in the screw bar of this invention. The invention in its broader aspects is, therefore, not limited to the specific details and illustrative examples shown and described. Accordingly, departure can be made from such details without departing from the spirit of applicants' general inventive concept.

What is claimed is:

1. A screw bar for connecting a nut member and a bearing member of a pantograph-type jack, comprising:

a cylindrical-shaped bar member having a predetermined diameter, a first end, and a second end;

a joint portion integral with said bar member at said first end and including a flange portion having a preselected outer diameter;

a threaded portion formed on said bar member at said second end, said threaded portion having a maximum outside diameter greater than said predetermined diameter of said bar member, said nut member being threadably engageable with said threaded portion; and a bearing support portion adjacent said joint portion, said bearing support portion having a desired diameter less than said preselected outer diameter of said flange portion and greater than or equal to said maximum outside diameter of said threaded portion, said bearing member being pivotally mountable on said bearing support portion.

2. The screw bar of claim 1, further comprising a lug portion mounted on said bearing support portion, said lug portion and said joint portion being positioned on opposite sides of said bearing member and preventing movement of said bearing member in the direction of the axis of said screw bar.

3. The screw bar of claim 1, further comprising a thrust washer pivotally mounted on said bearing support portion and interposed between said joint portion and said bearing member when said bearing member is mounted on said bearing support portion.

* * * * *